US005152244A

United States Patent [19]

Jarmillo, Jr. et al.

[11] Patent Number: 5,152,244

[45] Date of Patent: Oct. 6, 1992

[54] SELF-POSITIONING STIRRUP FOR A JET WATER CRAFT

[76] Inventors: Alfonso Jarmillo, Jr., 26671 Granvia Dr., Mission Viejo, Calif. 92691; Alfonso Jarmillo, Sr., 20205 Lounsberry Rd., Lake Matthews, Calif. 92570

[21] Appl. No.: 807,183

[22] Filed: Dec. 16, 1991

[51] Int. Cl.[5] ..... B63H 11/02

[52] U.S. Cl. ..... 114/362; 182/89

[58] Field of Search ..... 114/362, 270; 182/89–92; 441/39

[56] References Cited

U.S. PATENT DOCUMENTS

| | | | |
|---|---|---|---|
| 3,825,097 | 7/1974 | Owen | 182/91 |
| 3,862,670 | 1/1975 | Hovey | 182/89 |
| 3,986,503 | 10/1976 | Le Guillon | 182/89 |
| 4,191,388 | 3/1980 | Barksdale | 280/166 |
| 4,556,125 | 12/1985 | Johnson | 182/91 |
| 4,688,508 | 8/1987 | Nishida | 114/270 |
| 4,712,503 | 12/1987 | Ritten | 114/362 |
| 4,738,642 | 4/1988 | Koyama et al. | 440/38 |
| 4,926,965 | 5/1990 | Fox | 182/89 |
| 4,979,454 | 12/1990 | Van Den Heuvel | 114/270 |
| 5,014,640 | 5/1991 | Owen, Sr. | 114/362 |

FOREIGN PATENT DOCUMENTS

| | | | |
|---|---|---|---|
| 2-54092 | 10/1990 | Japan | 114/362 |

*Primary Examiner*—Jesûs D. Sotelo

*Attorney, Agent, or Firm*—Harvey S. Hertz; William T. O'Neil

[57] ABSTRACT

A "U-shaped" rigid stirrup member having a base and two legs extending from the base to the open ends of the "U" is mounted to the transom of a water craft symmetrically about the propulsion jet outlet. The mountings at the craft transom hinge the stirrup to facilitate the positioning of the "U" in a downward direction to act as a stirrup for boarding the craft and upward out of the way of the jet outlet and the water surface. A torsion spring at least at one of the hinge points automatically positions the stirrup upward after the craft is boarded but is easily overcome by hand to position the stirrup downward for boarding.

10 Claims, 1 Drawing Sheet

FIG. 1
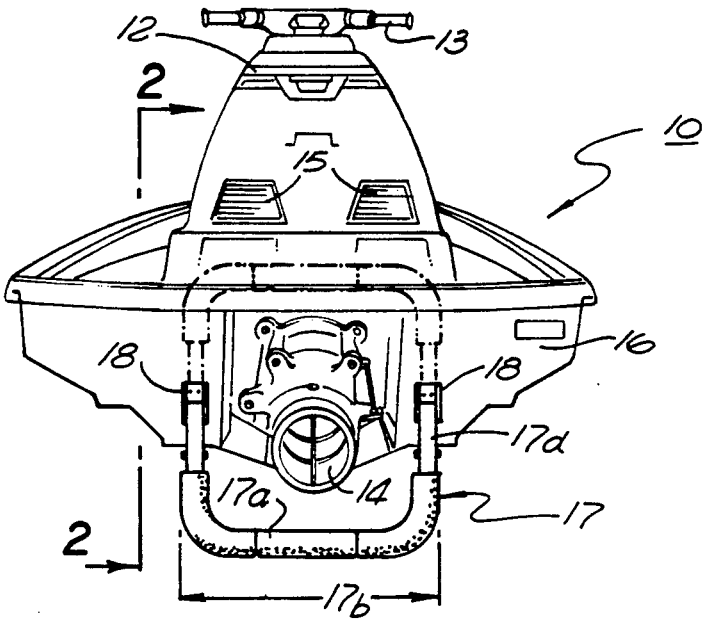
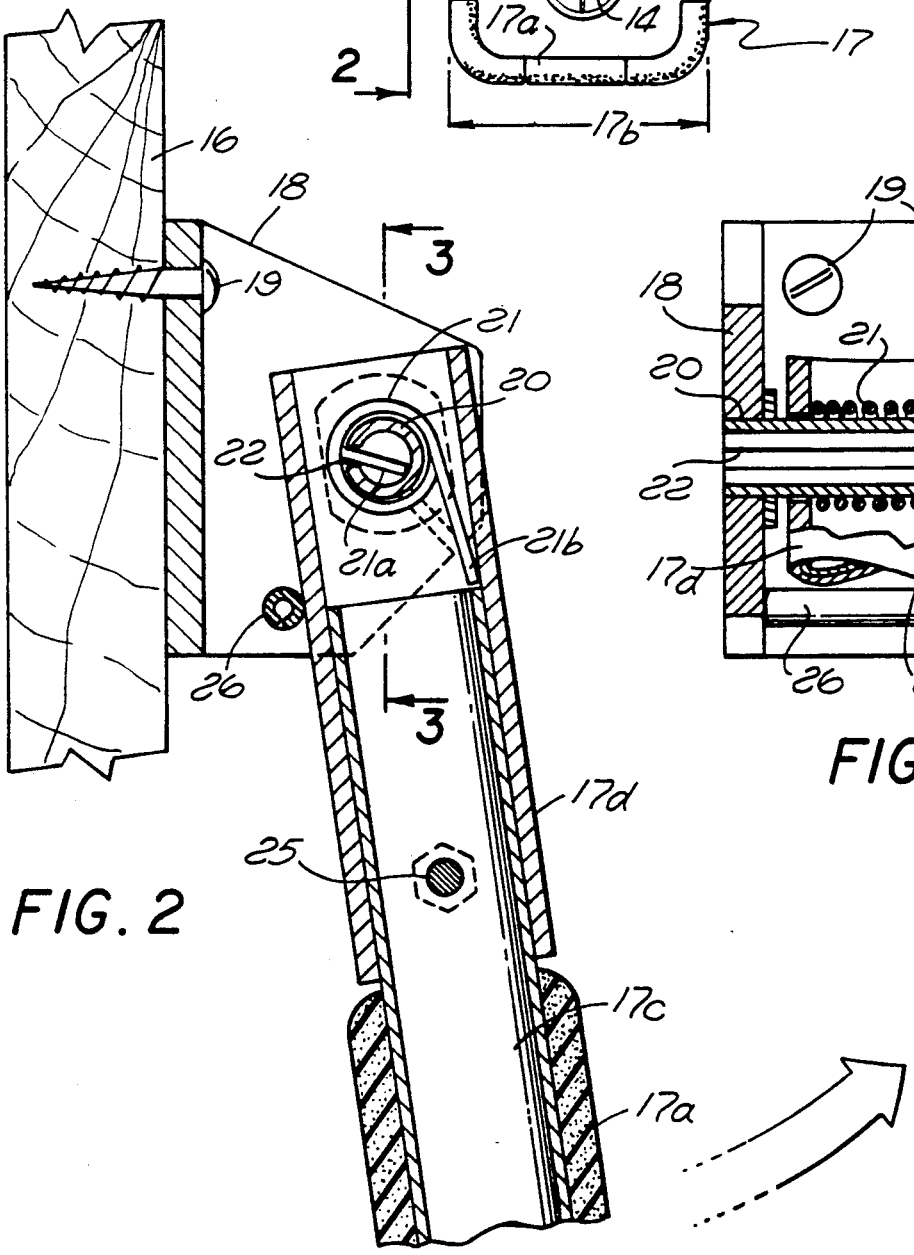
FIG. 2
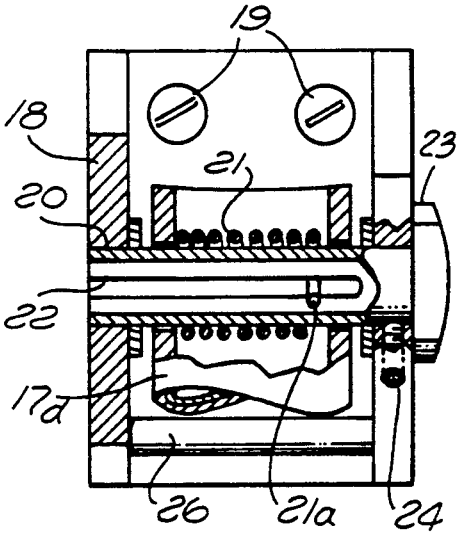
FIG. 3

SELF-POSITIONING STIRRUP FOR A JET WATER CRAFT

BACKGROUND OF THE INVENTION

1. Field of The Invention.

The invention relates generally to small water craft and, more particularly, to apparatus for facilitating the boarding of the craft from an in-water position.

2. Description of The Prior Art.

In the prior art, the problem presented by the need to board a small water craft from the water adjacent to the craft has been recognized and various solutions have been devised. The type of water craft most affected is small personal water craft on which an operator sits astride a mid-section engine compartment and controls the craft directionally and otherwise from this position. These water craft have many of the general characteristics of larger motor boats including a stern panel (transom).

The small water craft referred to almost always includes water jet propulsion to eliminate external propeller blades and mounting structure as a matter of safety and immunity to damage. The so-called "jet ski" is a craft of the same general type, except that the operator is in the standing position.

The prior art known to the applicant includes U.S. Pat. Nos. 4,926,965; 3,986,503; 3,862,670; 4,738,642; 3,825,097; 4,979,454; 5,014,640; 4,556,125; and 4,191,388. Of these patents, the first four appear to be of most interest.

U.S. Pat. No. 4,926,965 to Fox discloses a self-retracting stirrup for mounting at the stern of a water craft. A spring arrangement erects a pivotally mounted stirrup assembly in response to initial forward movement of the water craft to remove it from water contact and thereby eliminate the drag which would result from continued contact between the stirrup assembly and the water. The disclosure of U.S. Pat. No. 4,926,965 does not apply to smaller water craft having jet propulsion. Such craft would not normally have a permanently mounted boat step from which this reference projects a stirrup structure. Still further, a structure which depends on initial water craft motion is not well adapted to water jet craft. If the structure were centrally mounted on the transom, the jet outlet would cause much undesirable splash and spray as it passed over the jet outlet. Mounting such a stirrup structure asymmetrically with respect to the transom center would apply a substantial undesirable roll force during boarding, that being undesirable in a small water craft.

U.S. Pat. No. 3,986,503 discloses a structure for mounting a large earth moving machine superficially resembling the invention; however, it includes a locking device which engages in response to operator positioning of a step platform generally horizontally. A disengagement force must be applied to the step platform to return it to the stowed position. Such a requirement would be quite burdensome in the water craft application.

U.S. Pat. No. 3,862,670 discloses a boat ladder which is extended into the water by the weight of a user in boarding the boat, but which automatically telescopes by spring action into a more compact form when the user steps away. The device is said to be adapted to stern of side mounting, but in a small jet water craft, rearward mounting would interfere with the water jet and side mounting would apply an unacceptable roll couple to the craft, particularly a small craft.

U.S. Pat. No. 5,014,680 discloses a step assembly for a boat which is shown mounted off-center on the water craft transom. The assembly is hand-operated and has no self-retracting feature. Mounting of such a device off-center on the transom would produce a very undesirable roll couple on a small water craft, and centered mounting is precluded by the interference potential with the water jet or propeller assembly.

U.S. Pat. No. 4,738,642 discloses a telescoping or hinged step for stern boarding of a small water craft, but does not provide self-operating means to retreat the mounting board(s).

The remaining references listed hereinabove are not pertinent to the structure and advantageous operation of the invention.

The manner in which the invention deals with the disadvantages of the prior art to produce a novel self-positioning boarding step at the transom of a water craft without propulsion jet interference will be evident as this specification proceeds.

SUMMARY OF THE INVENTION

The invention provides a stern (transom) mounted boarding structure, particularly for a small (personal) jet water craft. The novel structure includes a "U-shaped" step forming a stirrup mounted symmetrically from the craft transom to avoid applying a roll couple to the craft. The "U-shaped" structure is spring-hinged at its open end against the craft transom. The spring force is sufficient to erect the base of the "U-shaped" structure above the jet outlet, but small enough to be easily overcome by hand from the water to lower the structure into the water for easy boarding of the craft. After boarding, the spring force erects the "U-shaped" member base at least above the jet outlet and therefore above the waterline in operation.

BRIEF DESCRIPTION OF THE DRAWINGS

FIG. 1 is a pictorial stern view of a water jet craft with the "U-shaped" self-positioning stirrup in place according to the invention.

FIG. 2 is a sectional view of a leg of the "U-shaped" structure taken as indicated on FIG. 1.

FIG. 3 is a further section of the self-positioning apparatus according to the invention taken as indicated on FIG. 2

DETAILED DESCRIPTION

Referring to FIG. 1, a typical personal water craft 10 is depicted from a stern view. The water craft per se is conventional. An engine and pump enclosure 11 houses the water jet drive which produces a powerful jet of water from a nozzle assembly 14 to drive the craft forward. The azimuth direction of this water jet from nozzle assembly 14 may be controllable by a handle bar assembly 13. This and other conventional controls are located at the handle bar assembly 13. The rider sits atop a seat 12 facing the controls at handle bar assembly 13. Vents 15 are engine compartment vents.

The water craft 10 contains a transom (stern panel) 16. A "U-shaped" rigid member 17 is provided , preferably covered at its lower portion, as indicated, by a sponge rubber plastic covering 17*a* for foot comfort, since the horizontal portion of the member constitutes the rung (step) 17*b* onto which a foot is placed in the boarding process. Before boarding, however, the "U-shaped" member 17 is rotated downward from its retracted position, as shown in dotted lines in FIG. 1. Springs at least at one of the channel brackets 18 serve to rotate the "U-shaped" member upward automatically upon release from foot pressure. The retracted position need not be directly vertical; in fact, it may be only enough to clear the jet nozzle 14.

Outer upper tubular members 17*d* form the upper portion of the legs of the U-shaped rigid member 17, the latter being and are assembled from tubing fitted over a smaller tube constituting the base section 17*c*. A through bolt 25 serves to join these fitted leg sections.

The two channel brackets 18 are mounted to the transom 16, as indicated. FIG. 2 shows typical attachment of channel brackets 18 to the transom 16. Normally, the transom structure is composed of a lay-up, such as of fiber glass and thermosetting plastic, and is therefore relatively thick so as to accept wood or self-tapping screws 19. Obviously, however, if the inside surface of the transom 16 is accessible, machine screws and nuts could be used to effect this attachment.

A slotted sleeve 20 has a torsion spring 21 slipped over it and an end 21*a* of spring 21 is captured in slot 22 of sleeve 20. See also FIG. 3. The other end 21*b* of torsion spring 21 bears against the inside of the tube 17*d*. In FIG. 3, the mechanism for winding up this spring 21 will be seen. Slotted sleeve 20 is rotatable within bores in the flanges of channel bracket 18. A cap portion 23 is integral with slotted sleeve 20 and when a wrench is applied to cap portion 23, the slotted sleeve may be rotated to pretension (wind up) spring 21. A set screw 24 serves to hold sleeves 20 in rotational position corresponding to the pre tensioned position of spring 21.

Normally, the structure depicted in FIG. 3 would be present at both channel bracket locations 18; however, since the torque applied by spring 21 is only that required to position the "U-shaped" member 17, the requirement can be met with the FIG. 3 detail at only one channel bracket 18.

It will be obvious from this description that the automatic upward positioning occurs without motion of the craft and accordingly, the rung 17*b* will not pass through a water jet from nozzle assembly 14 at any time, contrary to prior art forward motion activation schemes. The craft jet pump will not be operative during, and immediately after, the boarding process.

A rod 26 is mounted between the flanges of at least one channel bracket 18 as seen in FIG. 3 in particular. The rod 26 serves as a down-position stop operating against tube 17*d* (see FIG. 2) within the flanges of channel bracket 18.

From an understanding of the principles of the invention, various minor modifications will suggest themselves to those of skill in this art. Accordingly, it is not intended that the scope of the invention be regarded as limited to the showing of the drawings or the description herewith, but only by the claims appended hereto.

We claim:

1. A boarding assist device for a personal water craft having a water jet propulsion nozzle substantially laterally centered with respect to said transom, comprising:

a U-shaped rigid member having a base portion and two legs projecting therefrom to the open end of said U-shaped member;

hinge means attached to said transom of said craft at said open ends, said hinge means being located substantially along a line in the horizontal plane and laterally symmetrically with respect to said nozzle; and spring means associated with said hinge means for mechanically rotating said U-shaped rigid member upward to a first position at least such that said base portion is above-said nozzle except when said base is manually rotated downward against the force of said spring means to a second position below said nozzle to provide a footing for boarding said craft.

2. The combination according to claim 1 in which said spring means consists of a torsion spring operative between at least one of said U-shaped member legs and a portion of said hinge means affixed to said transom.

3. The combination according to claim 1 in which said spring means consists of a pair of torsion springs, one operative between each of said U-shaped member legs and a portion of a corresponding hinge means affixed to said transom.

4. The combination according to claim 2 in which means are included for adjusting the force applied by said torsion spring to a value sufficient to assure positioning of said U-shaped rigid member into said first position in the absence of said manually applied downward rotation, but small enough to permit easy downward rotation to said second position for boarding said craft.

5. The combination according to claim 2 in which said U-shaped member is fabricated from metallic tubing.

6. The combination according to claim 5 in which said hinge means includes a pair of channel brackets having outward projecting flanges and in which a slotted sleeve is rotatably installed through opposing bores in said flanges and through said metallic tubing; said torsion spring having first end inserted into the slot of said slotted sleeve and a second end bearings against the inside of said metallic tubing to produce a force couple for mechanically rotating said U-shaped member to said first position.

7. The combination according to claim 3 in which said U-shaped member is fabricated from metallic tubing.

8. The combination according to claim 7 in which said hinge means includes a pair of channel brackets having outward projecting flanges and in which a slotted sleeve is rotatably installed through opposing bores in said flanges and through said metallic tubing; said torsion spring having a first end inserted into the slot of said slotted sleeve and a second end boring against the inside of said metallic tubing to produce a force couple for mechanically rotating said U-shaped member to said first position.

9. The combination according to claim 6 in which said slotted sleeve includes a bolt head attached thereto laterally outward from a flange of said channel bracket for adjustment by a wrench and in which at least one set screw is provided through said channel bracket flange to secure said slotted sleeve in place after pre-tensioning of said torsion spring by wrench application to said slotted sleeve bolt head.

10. In a boarding assist device for a personal water jet personal water craft, the combination comprising:

a tubular U-shaped member having two legs and a base portion;

a pair of channel brackets mounted on the transom of said water craft;

a pair of slotted sleeves mounted through bores and generally horizontally through outward projecting flanges on said brackets;

a helical spring fitted over each of said slotted sleeves, said springs having ends fitted into the slots of said sleeves and bearing against the inside of a corresponding one of said legs whereby a force is exerted to position said U-shaped member upward above the jet nozzle of said craft except when a manually applied force applied by a person desiring to board said craft rotates said U-shaped member downward to provide a step for boarding assistance.

* * * * *